US006725844B2

(12) United States Patent
Banzhat et al.

(10) Patent No.: US 6,725,844 B2
(45) Date of Patent: Apr. 27, 2004

(54) HIGH-PRESSURE PUMP WITH AN ON-OFF VALVE FOR FEEDING FUEL TO AN INTERNAL COMBUSTION ENGINE

(75) Inventors: Werner Banzhat, Sindelfingen (DE); Peter Grabert, Bexbach (DE); Nicola Cimaglia, Putignano (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/318,876

(22) Filed: Dec. 13, 2002

(65) Prior Publication Data

US 2003/0079726 A1 May 1, 2003

Related U.S. Application Data

(62) Division of application No. 09/607,849, filed on Jun. 30, 2000, now Pat. No. 6,553,971.

(30) Foreign Application Priority Data

Jul. 2, 1999 (IT) ..... TO99A0572

(51) Int. Cl.[7] ..... F02M 37/04

(52) U.S. Cl. ..... 123/495; 123/198 DB; 417/255; 417/441; 417/454

(58) Field of Search ..... 123/198 D, 198 DB, 123/450, 510, 495; 417/206, 349, 440, 494, 470, 255, 441, 454; 137/454.4, 454.5

(56) References Cited

U.S. PATENT DOCUMENTS

| | | | | |
|---|---|---|---|---|
| 5,571,243 | A | 11/1996 | Arnold et al. | 123/198 DB |
| 5,979,297 | A | 11/1999 | Ricco | 417/470 |
| 6,129,518 | A | 10/2000 | Ricco | 417/206 |
| 6,406,278 | B1 | 6/2002 | De Matthaeis et al. | 417/454 |
| 6,450,788 | B1 * | 9/2002 | Grabert | 417/570 |

FOREIGN PATENT DOCUMENTS

| | | |
|---|---|---|
| DE | 197 38 502 | 9/1997 |
| DE | 198 18 385 | 4/1998 |

* cited by examiner

*Primary Examiner*—Mahmoud Gimie
*Assistant Examiner*—Hai Huynh
(74) *Attorney, Agent, or Firm*—Merchant & Gould, P.C.

(57) ABSTRACT

The pump has a body including at least a fuel compression chamber and an actuating chamber enclosing the actuating members of the pump. The on-off valve has a shutter sliding inside a hole in the body to close a fuel feed conduit. The shutter is held in the closed position by a compression spring, which rests directly or indirectly on a shoulder in the hole. In one embodiment, the spring rests on the shoulder via a perforated disk held by a retaining ring, which clicks removably inside an annular groove in the hole. In a further embodiment, the spring rests directly on the shoulder.

6 Claims, 2 Drawing Sheets

HIGH-PRESSURE PUMP WITH AN ON-OFF VALVE FOR FEEDING FUEL TO AN INTERNAL COMBUSTION ENGINE

"This application is a divisional of application Ser. No. 09/607,849, filed Jun. 30, 2000, now U.S. Pat. No. 6,553,971 which application(s) are incorporated herein by reference."

The present invention relates to a high-pressure pumps with an on-off valve for feeding fuel to an internal combustion engine, particularly a vehicle engine.

BACKGROUND OF THE INVENTION

Various types of high-pressure fuel feed pumps are known, and which are generally supplied with fuel from a normal tank by a low-pressure pump powered by an electric motor. The high-pressure pump normally comprises an on-off valve, which is opened automatically by the fuel fed to it by the low-pressure pump.

The body of known high-pressure pumps encloses at least a fuel compression chamber, and an actuating chamber housing pump actuating members; and the on-off valve comprises a shutter designed to ensure fuel flow to the actuating chamber, even when the valve is closed, to lubricate and cool the actuating members.

In one known radial-piston pump in particular, the pumps body houses three cylinders, in which slide respective pistons activated by a common cam carried by a shaft activated by the drive shaft; the cam is housed inside the actuating chamber or case of the pump; and the shutter is in the form of a hollow cylinder and slides along the wall of a radial hole in the pump body.

The pump body also has a fuel feed conduit for feeding fuel from the radial hole to the cylinders; the feed conduit is closed by the lateral wall of the shutter; and, to lubricate and cool the pump shaft, the cam, and the various pump body and piston friction surfaces, the shutter also has a calibrated axial hole permitting continuous fuel flow to the case.

To prevent fuel accumulating in an engine cylinder, in the event the respective injector breaks down, or to prevent fuel from being drawn from the actuating chamber in the event of poor or no supply by the low-pressure punts e.g. due to a fault, the shutter is closed automatically by a compression spring when the pressure of the incoming fuel falls below a given value.

The compression spring is housed inside the shutter and rests on a perforated plate, which has a surface for receiving the end of the spring and is normally fixed, e.g. welded, to the opposite end of the guide hole of the shutter.

In this known type of pump, machining the radial hole in the pump body, fixing the plate, and assembling the spring are difficult, high-cost operations involving considerable time and highly skilled personnel. Moreover, the perforated plate at the end of the hole facing the case limits to a certain extent the outside diameter of the cam and, hence, the capacity of the pump under given conditions.

SUMMARY OF THE INVENTION

It is an object of the invention to provide an extremely straightforward, reliable high-pressure pump having an on-off valve which is cheap to produce and easy to assemble, so as to eliminate the aforementioned drawbacks of known pumps with on-off valves.

According to the present invention, there is provided a high-pressure pump with an on-off valve for feeding fuel to an internal combustion engine, wherein the pump comprises a body including at least a fuel compression chamber and an actuating chamber enclosing actuating members of said pump, and wherein said valve comprises a shutter sliding inside a hole in said body to close a fuel feed conduit; said feed conduit being formed in said body, between said hole and said compression chamber; and said shutter being held in the closed position by a compression spring; characterized in that said spring rests directly or indirectly on a shoulder inside said hole; said shoulder being formed in one piece with said body.

In a first embodiment of the invention, the spring rests on the shoulder by virtue of means fixed removably inside the hole and comprising a perforated disk inserted removably inside the hole, and an elastic C-shaped metal element located, between the disk and the shoulder, inside an annular groove adjacent to the shoulder.

In a further embodiment of the invention, the spring rests directly on the shoulder, and the wall of the hole has an annular groove permitting precision machining of the wall.

BRIEF DESCRIPTION OF THE DRAWINGS

Two preferred, non-limiting embodiments of the invention will be described by way of example with reference to the accompanying drawings, in which.

DETAILED DESCRIPTION OF THE INVENTION

Figure 1:
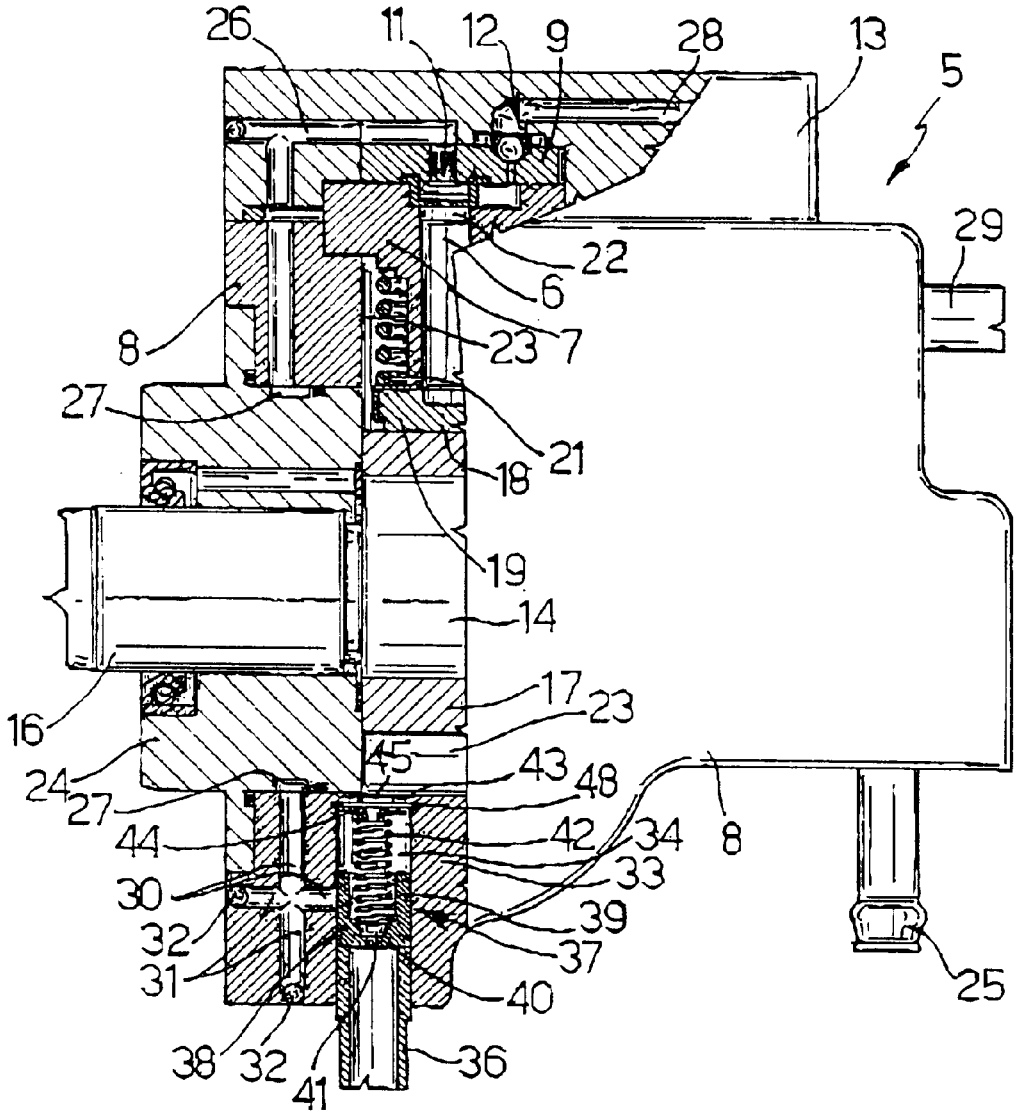
FIG. 1 shows a partly sectioned side view of a high-pressure pup with an on-off valve for feeding fuel to en internal combustion engine, in accordance with the invention.

Number 5 in FIG. 1 indicates as a whole a high-pressure pump for feeding fuel to an internal combustion engine, e.g. of a vehicle. Pump 5 is supplied with fuel from, a normal tank by a low-pressure pump (not shown) powered by an electric motor energized when the engine is turned on.

High-pressure pump 5 is of the type comprising three radial pistons 6, which slide inside three cylinders 7 arranged radially inside a body 8 of pump 5; each cylinder 7 is closed by a plate 9 supporting an intake valve 11 and a delivery valve 12; and each cylinder 7 and respective plate 9 are locked to body 8 by a corresponding lock head 13.

Pistons 6 are activated in sequence by a single cam 14 integral with a shaft 16 powered by the internal combustion engine drive shaft. Cam 14 acts on pistons 6 via a ring 17 having, for each piston 6, a faced portion 18 cooperating with a shoe 19 fixed to piston 6; and each shoe 19 is pushed towards the cam by a corresponding spring 21.

The gap between the end of each piston 6 and respective plate 9 defines a compression chamber 22, so that the three compression chambers 22 are obviously housed inside body 8. The space inside body 8 housing cylinders 7 and in which shaft 16 and cam 14 rotate forms an actuating chamber 23 of pump 5, which chamber is closed by a flange 24 fixed in known manner to body 8; shaft 16 is fitted in rotary and fluidtight manner to flange 24; and chamber 23 communicates in known manner with a drain conduit 25 draining into the tank.

Body 8 is made of cast iron, and heads 13 of steel; body 8 and heads 13 have three intake conduits 26 communicating with a conduit defined by an annular groove 27 on flange 24; each conduit 26 also communicates with the corresponding compression chamber 22 via corresponding intake valve 11; and each head 13 also has a compression conduit 28, which, via corresponding delivery valve 12, connects compression chamber 22 to a delivery conduit 29 of pump 5.

Body 8 also has a feed conduit 30 formed by two holes 31 arranged crosswise to each other and closed outwards by two plugs 32. At one end, conduit 30 communicates with annular groove 27 of flange 24 and, therefore, with compression chambers 22; and, at the other end, conduit 30 comes out at a cylindrical wall 33 of a cylindrical radial hole 34 formed in body 8. Hole 34 communicates with actuating chamber 23 and projects partly towards flange 24; and an inlet conduit 36 connected to the low-pressure pump is inserted inside hole 34.

Hole 34 houses an on-off valve indicated as a whole by 37 and comprising a hollow, cylindrical shutter 38. More specifically, shutter 38 is piston- or cup-shaped, and comprises a lateral wall 39, which slides accurately along wall 33 of hole 34, so that both wall 33 of hole 34 and wall 39 of shutter 38 must be precision machined.

Shutter 38 also comprises a flat wall 40, which has a calibrated hole 41 permitting the passage of a certain amount of fuel, even when conduit 30 is closed by shutter 38. A helical compression spring 42 is inserted inside shutter 38 and rests on a supporting element fixed to the end of hole 34 facing actuating chamber 23; and the supporting element must be perforated to permit fuel passage from hole 34 to actuating chamber 23, as described in Italian Patent Application N. TO95A 000010.

According to the invention, the supporting element of spring 42 is defined by a shoulder 43 of hole 34, formed in one piece with body 8 and located at the end of hole 34 adjacent to actuating chamber 23. Shoulder 43 defines a circular opening 45 (FIG. 2) smaller in diameter than hole 34; and spring 42 rests directly or indirectly on shoulder 43, thus simplifying assembly of on-off valve 37.

Figure 2:
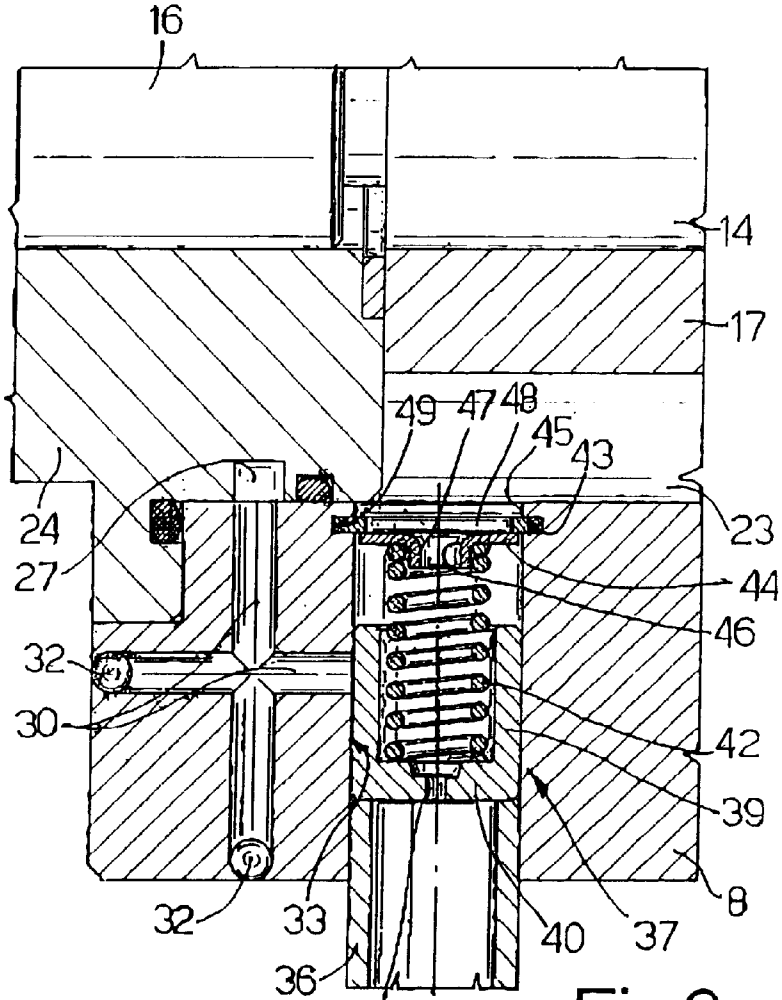
FIG. 2 shows a larger-scale section of the valve and a portion of the pump, according to a first embodiment of the invention.

In the FIG. 2 embodiment, spring 42 rests on shoulder 43 by virtue of means fixed removably inside hole 34 and comprising a disk 44 having a central opening 46 permitting fuel passage from hole 34 to actuating chamber 23. Advantageously, the difference in diameter between hole 34 and opening 45 ranges between 1 and 3 mm, and shoulder 43 is of a thickness ranging between 2 and 4 mm.

Opening 46 in disk 44 has a protruding edge 47 for guiding one of the ends of spring 42; and disk 44, together with opening 46 and protruding edge 47, may be formed cheaply from sheet metal by means of a punching and cold forming or embossing press.

Figure 3:
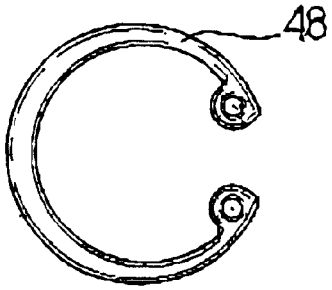
FIG. 3 shows a larger-scale plan view of a detail in FIG. 2.

The means fixed removably inside hole 34 also comprise a radially flexible C-shaped metal element 48, e.g. a standard retaining ring (FIG. 3), housed inside hole 34 (FIG. 2), between disk 44 and shoulder 43. More specifically, wall 33 of hole 34 has an annular groove 49 adjacent to shoulder 43, and into which ring 48 clicks removably and the diameter of opening 45 is such as to enable groove 49 to be machined through opening 45.

Ring 48 is fitted inside groove 49 or removed from the groove by bringing the two ends of ring 48 together, so that the parts of valve 37 are obviously also easy to assemble, the only precaution being to assemble disk 44 with edge 47 facing spring 42.

Figure 4:
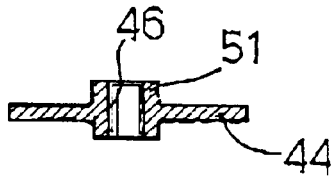
FIG. 4 shows a section of a further detail of a variation of FIG. 2.

To eliminate even the above precaution and/or simplify automatic assembly of valve 37, in the FIG. 4 variation, opening 46 of disk 44 may be provided with a ring 51 forming two edges symmetrical with respect to disk 44 and projecting axially in two opposite directions. Ring 51 may be welded to or formed in one piece with disk 44 by compacting and sintering metal powder.

Figure 5:
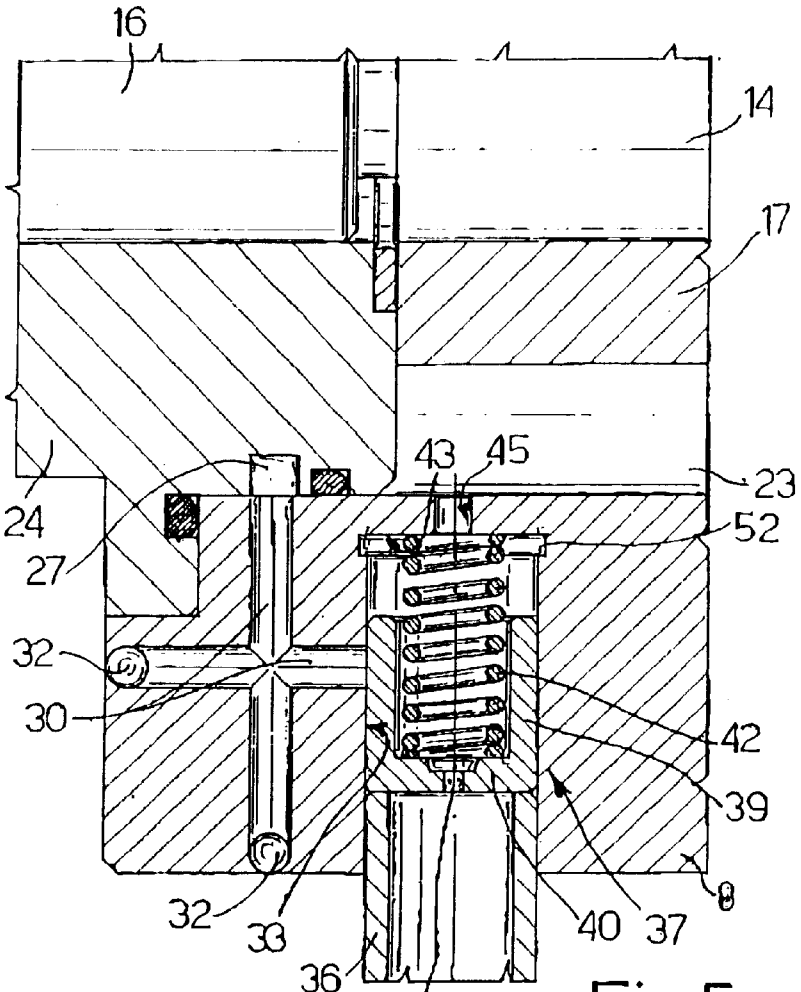
FIG. 5 shows a larger-scale section of the valve and a portion of the pump, according to a further embodiment of the invention.

In the FIG. 5 embodiment, spring 42 rests directly on shoulder 43. Advantageously, the diameter of opening 45 ranges between 3 and 5 mm, and shoulder 43 is of a thickness ranging between 5 and 8 mm. To permit fine machining of wall 33 of hole 34 from outside body 8, an annular groove 52 is machined in wall 33, and which may be shallower than groove 49 in FIG. 2, so that valve 37 in FIG. 5 is even cheaper to produce than that in FIG. 2.

As compared with known pumps, the advantages of the high-pressure pump according to the invention will be clear from the foregoing description. In particular, removable assembly of disk 44 and ring 48 reduces production cost of the pump; shoulder 43 eliminates the need to fix the supporting element of spring 42 inside hole 34; and there is no interference between cam ring 17 and the supporting element of spring 42, so that the diameter of cam 14 can be increased to increase pump capacity.

Clearly, changes may be made to the high-pressure pump as described herein without, however, departing from the scope of the accompanying claims. For example the pistons of pump 5 may be arranged otherwise than as described; and the pump may be applied to other than a vehicle engine.

What is claimed is:

1. A high-pressure pump with an on-off valve for feeding fuel to an internal combustion engine, wherein the pump comprises a body including at least a fuel compression chamber and an actuating chamber enclosing actuating members of the pump, and wherein said valve comprises a shutter sliding inside a hole in said body to close a fuel feed conduit; said feed conduit being formed in said body, between said hole and said compression chamber; said shutter being held in the a closed position by a compression spring; and wherein said spring rests directly or indirectly on a shoulder inside said hole; said shoulder being formed in one piece with said body, said shoulder being defined by an opening of a diameter ranging between 3 and 5 mm.

2. A high-pressure pump as claimed in claim 1, wherein a cylindrical wall of said hole has an annular groove adjacent to said shoulder to permit precision machining of said wall.

3. A high-pressure pump as claimed in claim 1, wherein said shoulder is of a thickness ranging between 5 and 8 mm.

4. A high-pressure pump as claimed in claim 1, further comprising a number of cylinder arranged radially inside said body and a number of pistons associated with said cylinders and sliding radially; said actuating members comprising a common cam formed in one piece with a shaft and said cam and said shaft being housed in said actuating chamber.

5. A high-pressure pump as claimed in claim 4, wherein said cam activates said pistons via a ring having a number of faced portions each of said portions engaging a shoe carried by a corresponding piston and said ring and said shoes being housed in said actuating chamber.

6. A high-pressure pump with an on-off valve for feeding fuel to an internal combustion engine, wherein the pump comprises a body including at least a fuel compression chamber and an actuating chamber enclosing actuating members of the pump, and wherein said valve comprises a shutter sliding inside a hole in said body to close a fuel feed conduit; said feed conduit being formed in said body, between said hole and said compression chamber; said shutter being held in the closed position by a compression spring; and wherein said spring rests directly on a shoulder inside said hole; said shoulder being formed in one piece with said body; said shoulder being defined by an opening of a diameter ranging between 3 and 5 mm.

* * * * *

UNITED STATES PATENT AND TRADEMARK OFFICE

CERTIFICATE OF CORRECTION

PATENT NO. : 6,725,844 B2
DATED : April 17, 2004
INVENTOR(S) : Banzhaf et al.

It is certified that error appears in the above-identified patent and that said Letters Patent is hereby corrected as shown below:

Title page,
Item [12], "Banzhat et al." should read -- Banzhaf et al. --.
Item [75], Inventors, "Banzhat" should read -- Banzhaf --.

Signed and Sealed this

Sixth Day of September, 2005

JON W. DUDAS
*Director of the United States Patent and Trademark Office*